US006399160B1

(12) United States Patent
Grön et al.

(10) Patent No.: US 6,399,160 B1
(45) Date of Patent: Jun. 4, 2002

(54) METHOD AND APPARATUS FOR FILM COATING A MOVING PAPER OR BOARD WEB SUPPORTED BY A BELT TO FORM A COATING APPLICATION ZONE WITH ADJUSTABLE LENGTH

(75) Inventors: Johan Grön, Jyväskylä; Jorma Kinnunen, Järvenpää; Mikko Tani, Helsinki; Erja Nikula, Vantaa, all of (FI)

(73) Assignee: Valmet Corporation, Helsinki (FI)

( * ) Notice: Subject to any disclaimer, the term of this patent is extended or adjusted under 35 U.S.C. 154(b) by 0 days.

(21) Appl. No.: 09/091,199

(22) PCT Filed: Apr. 24, 1998

(86) PCT No.: PCT/FI98/00362

§ 371 (c)(1),
(2), (4) Date: Jul. 6, 1999

(87) PCT Pub. No.: WO99/55966

PCT Pub. Date: Nov. 4, 1999

(51) Int. Cl.[7] ..... B05D 1/28; B05C 1/12

(52) U.S. Cl. ..... 427/542; 427/541; 427/355; 427/356; 427/372.2; 427/402; 427/428; 118/68; 118/70; 118/123; 118/224; 118/239; 118/246; 118/248; 118/249; 118/250; 118/251; 118/253

(58) Field of Search ..... 427/428, 402, 427/355, 356, 541, 542, 372.2; 118/239, 246, 248, 249, 250, 251, 253, 224, 70, 123, 68

(56) References Cited

U.S. PATENT DOCUMENTS

| | | | | |
|---|---|---|---|---|
| 2,937,955 A | | 5/1960 | Loomer | |
| 5,340,611 A | | 8/1994 | Kustermann et al. | |
| 5,547,509 A | * | 8/1996 | Neider et al. | 118/68 |
| 5,792,320 A | * | 8/1998 | Kaasalainen et al. | 162/210 |
| 6,103,314 A | * | 8/2000 | Kinnunen | 427/428 |
| 6,123,770 A | * | 9/2000 | Koskinen et al. | 118/110 |

FOREIGN PATENT DOCUMENTS

| | | | |
|---|---|---|---|
| EP | 770 730 A1 | * | 5/1997 |
| JP | 9-87997 | * | 3/1997 |
| WO | WO 95/28522 | | 10/1995 |

* cited by examiner

*Primary Examiner*—Katherine A. Bareford
(74) *Attorney, Agent, or Firm*—Cohen, Pontani, Lieberman & Pavane

(57) ABSTRACT

A method and apparatus for coating a paper or board web, wherein the web to be coated is brought to a film transfer coater and taken to a nip between the film transfer roll of the coater and its backing roll, and coating mix is applied onto the surface of the film transfer roll. The web is taken through the nip between the rolls and the rolls are turned, whereby the coating mix applied onto the applicator roll is at least partly transferred onto the surface of the web. The web is supported through the nip by means of a belt traveling at the same speed as the web, the belt having been arranged to travel on the backing roll. The web is taken onto the surface of the belt prior to the nip and separated from the belt after the nip, and it is pressed against the film transfer roll by means of the belt. The length of the path where the web and the film transfer roll are in contact with each other is controlled by varying the position of the web and the belt.

29 Claims, 5 Drawing Sheets

METHOD AND APPARATUS FOR FILM COATING A MOVING PAPER OR BOARD WEB SUPPORTED BY A BELT TO FORM A COATING APPLICATION ZONE WITH ADJUSTABLE LENGTH

CROSS-REFERENCE TO RELATED APPLICATIONS

This is a national stage application of PCT/F198/00362, filed Apr. 24, 1998.

FIELD OF THE INVENTION

The present invention relates to a method and apparatus for coating a moving board or paper web by the film transfer coating method and for coating the web twice whereby the film transfer coater of the invention is used in the first or the second coating step.

BACKGROUND OF THE INVENTION

Paper or board can be coated with one or more coating layers in order to improve its printability. The more coating layers are applied, the higher the attained paper quality, simultaneously enabling the use of coating agents having different properties. However, the use of two coating layers entails a significant increase in production costs because the coating is usually carried out in separate steps and the applied coating layer has been dried prior to the application of the next layer.

The coating can be performed either directly onto the surface of the paper by means of e.g. a blade or a rod coater or by means of a film transfer coater whereby film which has been premetered onto a film roll is transferred onto the paper surface in a roll nip. It is typical of the blade and rod coating methods that the doctor blade fills the roughness volume of the coating underlayer and evens out the surface whereby the thickness of the coat varies in accordance with the roughness volume variations of the coating underlayer. A smooth coat results having an uneven brightness coverage, and the uniform absorption properties of the coat are difficult to control.

In film transfer coating, a coat of an essentially more uniform thickness is obtained rendering it easy to control the absorption properties, but sufficient smoothness properties pose a problem particularly in the case of thicker papers and boards. The coating also provides quite an even coverage whereby, for example, the brightness of a coating underlayer of low brightness can be significantly improved by means of this coating method. Furthermore, as no doctor blade trailing along the coating underlayer is involved in film transfer coating, the method offers excellent runnability with respect to coating breaks. A problem hampering film transfer coating, however, is posed by the fuming of the coating and the so called orange peel pattern which is due to splitting of the surface of the coating on the web detached from the film transfer roll and the film forming the coat on the roll surface, the orange peel pattern being observable as small craters in the coating. Such fuming and the formation of an orange peel pattern restrict to some extent the maximum coating speed.

Two separate ways of exploiting the special properties of the blade and film transfer coating methods have been sought.

Film transfer coating is widely used in precoating and in front coating. When used as precoat it improves the coating result due to the total coat weight alone, and the inclusion of even just one blade coat is a guarantee for sufficient smoothness. The precoat is usually dried before the following surface coat which is usually applied by means of a blade coater. From U.S. Pat. No. 2,937,955, it is also known to perform blade coating directly onto the half-wet film precoating. A prerequisite for this method is that the precoat is sufficiently set to withstand surface coating by a blade. The setting can be enhanced e.g. by partial drying of the precoat if the coat has not undergone sufficient dehydration due to filtration caused by pressure penetration in the coating nip and water absorption in the free gap between the pre- and surface coaters.

The delay and setting time between the film precoating and the blade surface coating can be extended e.g. by increasing the length of the travel of the web between the coaters, whereby a sufficiently set and dried precoat is achieved during the extended absorption time into the web for the next blade coating step. U.S. Pat. No. 5,340,611 describes a method where the amount of film coating is kept so small that the doctor blade of the blade coater does not remove the precoat by doctoring. In this manner, however, the great amount of applied coating allowed by the film transfer coater cannot be exploited, and the resulting thickness of the first coating layer is very small. In the second step, it is also possible to use a rod instead of a blade.

In pilot-scale test runs for coating paperboard, the 10 $g/m^2$ precoat could not be made to set sufficiently by the method even if the delay time between the coating events was extended, in order for the next blade coating step not to partly remove the already applied precoat by doctoring. A further problem was that when the web speed was determined by the film coating nip and when the web speed was reduced by the following blade coating event, a tendency appeared for a bag or a loose section to be formed in front of the blade resulting in web breaks. Thus, in this case the method did not work. The probability of web breaks is further increased because the blade coating which strains the web to a much greater extent than film transfer coating is performed while the web is damp, the strength of a damp web naturally being inferior to the strength of a dry web.

A second alternative for exploiting the special properties of film and blade coats is described in the applicant's Finnish Patent Application No. 941803 wherein the coating unit is constructed such that either film transfer coating or blade coating can be used as alternative methods depending on what is required of the final product and/or on considerations relating to runnability, whereby, however, the same coat drying apparatus is used for both methods. This apparatus can not be used to exploit the benefits of two-layer coating wherefore it chiefly increases the flexibility of production but does not improve the quality of the final product as compared to corresponding single-layer coating methods.

Particularly in the case of thick papers and boards the need exists to combine the benefits provided by film transfer coating and blade coating. Due to the space required as well as the investment costs incurred, however, intermediate drying of the precoat is not always possible. In this case the only alternative available is the above-described wet-on-wet coating, but current methods will not achieve sufficient total coat weights to allow the best possible exploitation of the good coverage obtained by film transfer coating and the good smoothness properties achieved by blade coating.

The film transfer coating method can also be used to provide the surface coat whereby the layer produced by the film transfer coating method and applied onto the first layer which has been evened out by means of a blade or rod is smooth.

SUMMARY OF THE INVENTION

The present invention is particularly well suited for wet-on-wet coating whereby the second coating layer is applied onto an at least partly wet first coating layer.

The present invention aims at achieving a film transfer coating method by which the coating event can be controlled more reliably than has been the case, thus obtaining improved runnability and increased coating speed of the film transfer coater.

The invention is based on taking the web being coated through the film transfer nip supported by a belt, and the angle of the belt over the applicator roll is controlled such that the contact distance between the web and the roll can be altered.

Further in the double coating method according to the invention the web is taken through two successive coating steps supported by a belt and one coating step is performed by means of a film transfer coater and the other e.g. by means of a short-dwell coater.

The invention offers considerable benefits.

The controllability of the roll applicator station can be essentially improved by means of the belt because by varying the incoming angle and the angle of departure of the belt it is possible to affect the introduction of the web being coated into the nip, its detachment from the surface of the applicator roll, and the wetting time and pressure. By extending the wetting time, i,e the delay time of the film transfer event, a better absorption of the coating into the web is achieved, whereby a thicker first coating layer can be made to adhere to the surface of the web. Particularly in double coating this has a significant effect because, due to the better absorption, a sufficient amount of coating can be made to remain on the web surface even after blade coating. If, then, the blade coating step precedes the film transfer coating, the belt provides improved coating smoothness because it can be used to control the angle of detachment of the web from the applicator roll such that the formation of, e.g. an orange peel pattern is minimal. The use of a belt and the belt angle control before the web enters the nip and when it leaves the nip serve to provide further improved runnability of the web, and controlled web detachment reduces the formation of the orange peel pattern. Naturally, a rod can be used as the doctoring means instead of a blade.

In applicator roll application the belt replaces the soft roll. The belt is easier to replace once it is worn and it is considerably less costly than a roll. Thus, the belt can be replaced after short periods of use. Good runnability is provided in double coating because in the first step, the wetted web is supported by a belt whereby the web itself is subjected to less strain. A belt-supported web does not form bags as easily as a web which lacks support. In the precoating step, an inexpensive coating mix can be used to even out the surface of the paper, and blade coating is performed using a more costly finely divided coating mix, whereby good printability and coverage properties are obtained.

Belt support during the entire film transfer process provides additional possibilities of coating surface sizing even the lightest paper grades. The support can be utilized to better control detachment of the web from the film transfer roll without the web flapping between the roll surface and the supporting belt. Uncontrolled detachment exposes the web to mechanical strain which may lead to marking of the treated surface or even break the web. The extended contact distance after the roll nip reduces fuming of the coat with the increasing distance between the nip and the point of detachment and the decreasing angle of detachment because the separation force is then reduced at the splitting point of the film.

By changing the distance of the contact point between the belt-supported web and the film transfer coater from the roll nip it is possible to increase the amount of coating mix transferred onto the web. When the web touches the coating film on the roll surface, water contained in the coating begins to be transferred to the web due to capillary and pressure penetration. A layer of packed pigment particles is formed on the web surface at the coating/web interface, which reduces the flow speed of the liquid phase and the solid phase onto the web. The contact distance can be varied in order to provide or to maintain the desired contact time at a greater speed or a greater coat weight or when the driving parameters are altered in some other way. Belt stretch can be used to control the application pressure but the pressure pulse caused by the belt is always smaller than that of the roll nip.

The increased contact distance makes a greater run speed and a greater coat weight possible with one application event without runnability problems such as fuming of the coat from the nip of formation of patterns on the coated surface. Due to the increased contact distance, an improved coat coverage is also obtained and penetration of the coating into the web is reduced and the coating is kept on the web surface.

Other objects and features of the present invention will become apparent from the following detailed description considered in conjunction with the accompanying drawings. It is to be understood, however, that the drawings are intended solely for purposes of illustration and not as a definition of the limits of the invention, for which reference should be made to the appended claims.

BRIEF DESCRIPTION OF THE DRAWINGS

In the drawings, wherein like reference numerals delineate similar elements throughout the several views.

DETAILED DESCRIPTION OF THE PRESENTLY PREFERRED EMBODIMENTS

Figure 3:
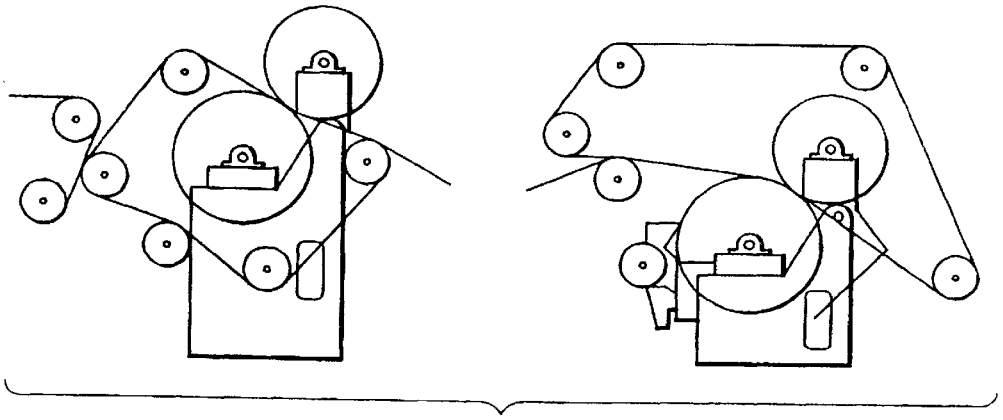
FIG. 3 depicts belt-supported coaters for treating the underside and the top side of the web.

The general principle behind the present invention lies in supporting the web during coating or surface sizing for applying the coating mix onto the web as a premetered layer or for blade coating, whereby the applied coating mix layer is evened out using a doctor blade. During the coating process the coating suspension is applied onto the web in two steps such that both sides of the web are treated separately. In multi-layer coating several treatment steps are applied. The belt is arranged as a supporting means either under or on top of the web in accordance with FIG. 3 depending on which side is to be coated. The belt can be used as a supporting means between the web and the backing roll or the web can be pressed against the film transfer roll directly by means of the belt without using a special backing roll. If the belt is the only means supporting the web and providing the application pressure, application pressure is controlled by controlling web tension. The contact distance can be controlled and the web supported by means of an additional idle roll or backing roll for instance so as to ensure a straight and precise contact line between the web and the film transfer roll.

The coating mix is applied onto the surface of the film transfer coater before the roll touches the web and in this case the belt can be used to control the contact distance and angle before the nip between the film transfer roll and the backing roll, and after said nip. The contact distance is varied by varying the incoming angle and the angle of departure of the web and the belt in relation to the film transfer roll. The web and the belt can of course be taken through the coater at predetermined angles.

In some cases the coating mix may stain the surface of the belt whereby belt cleansing is required. The smoothness and other physical properties of the belt are altered if it is not cleaned, and the altered properties will affect the quality of the coat provided onto the web, as well as the reproducibility of said quality. The belt can be cleaned using a doctor knife (FIG. 7) or liquid, air or steam jets (FIG. 8) whereby no mechanical contact with the belt is required. According to the invention the web can also be dried (FIG. 9) before it is separated from the supporting belt, making different web paths possible without damaging the coat, and the treated side of the web can for instance be brought in contact with the roll or cylinder surface after drying when the web is delivered off the belt. The dryer may comprise an infrared or some other radiating device, a microwave or another such electromagnetic radiating dryer, a blast dryer, a coanda dryer or some other dryer where the web is supported by means of the flow, a one-sided inverted drying funnel, or a corresponding device.

Figure 1:
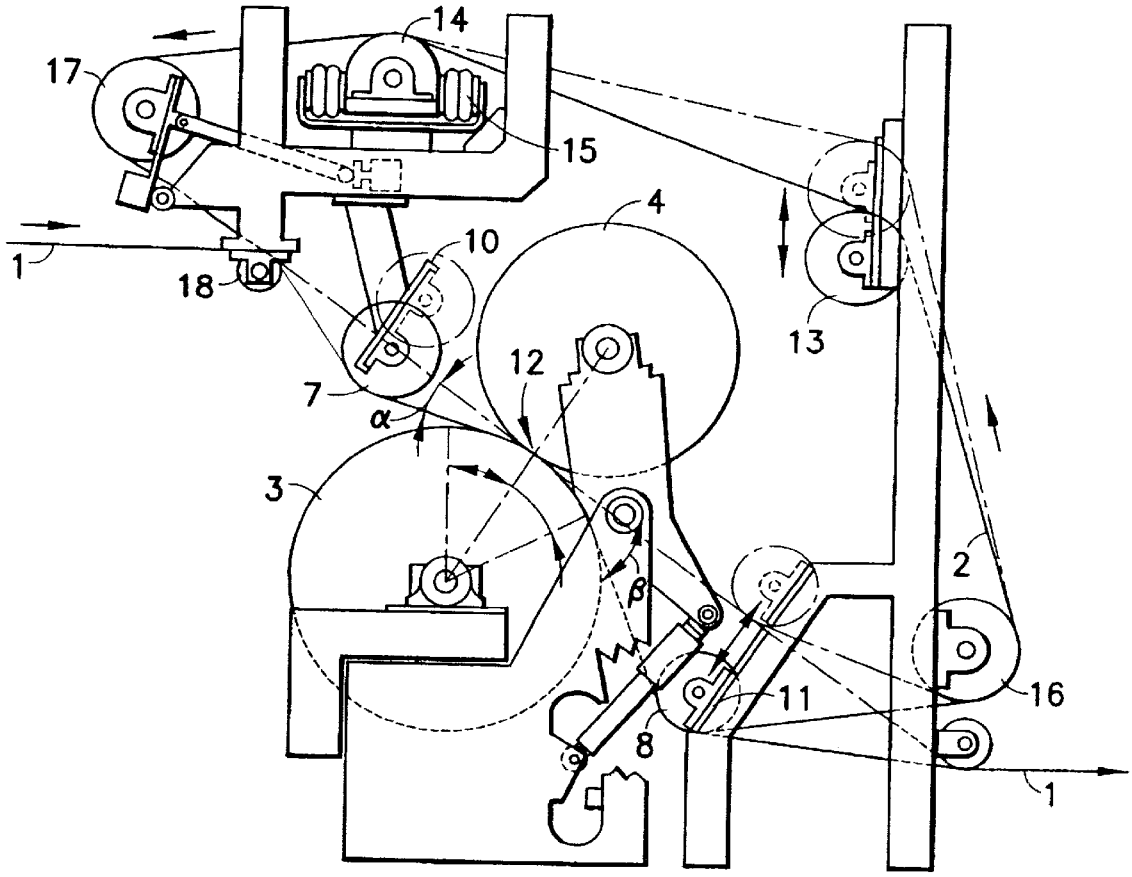
FIG. 1 is a schematic view of a film transfer coater according to the present invention.

FIG. 1 depicts a belt-supported film transfer-coater where the incoming angle $\alpha$ of the web 1 to be coated relative to the film transfer coater 3 and the angle $\beta$ of web as it departs from the roll 3 can be controlled by altering the tension of the belt 2 supporting the web 1. The coater comprises an applicator roll 3, a backing roll 4 forming a nip therewith, and a belt 2. The coating mix is applied onto the surface of the film transfer roll 3 by means of a blade or rod applicator, a jet applicator, spray applicator, gate-roll applicator, or even by means of pool application, and it is transferred from the roll surface onto the web surface. The belt 2 is arranged to travel via several guide rolls and its speed is adjusted such that it is equal to the speed of the web being coated. The guide rolls 7, 8 are arranged on both sides of the roll nip. The guide roll 7 on the incoming side of the web 1 can be moved by means of a spiral bar 10, thereby altering the incoming angle $\alpha$ of the web. The incoming angle is the sector of the applicator roll which is covered by the web 1 and the belt 2 supporting the web at each control position of the guide roll 7 on the incoming side prior to the center point of the nip 12. Correspondingly, the guide roll 8 on the departure side can be moved by means of a guide track 11, thus varying the angle $\beta$ of departure which is the sector on roll 3 defined by the center point of the nip 12 and the point of detachment of the web 1. These angles can also be called the precoverage area and the postcoverage area. Furthermore, in FIG. 1 no actuators are shown for varying the position of the guide rolls 7 and 8 by means of remote control or an automatic system e.g. while the apparatus is in operation, but such controls are simple to implement e.g. by means of spiral rode and controllable electric motors. The force applied when the web 1 is pressed against the applicator roll is controlled by altering the tension of the belt by means of both the guide rolls 7, 8 and the backing roll 4. The backing roll 4 may serve as a pressing roll by means of which the nip pressure is controlled whereby no control implemented by varying the tension of the belt is necessary, or it may be used as a second controlling alternative. By using both belt tension control and control of the nip pressure implemented by means of the backing roll, a changing pressure is obtained over the length of the path of the applicator roll 3 and the web covered under mutual contact.

As the distance covered by the belt 2 changes when the guide rolls 7, 8 are shifted, the change must be compensated by moving at least one other guide roll. In this case the compensation is performed by means of a dancer roll 13 which has been arranged to move along a guide track. The belt 2 tension is kept right by means of a tension roll 14 furnished with a pair of bellows 15. In addition to the above-mentioned rolls the belt 2 is guided by creasing rolls 16 and 17 which may also be movable. In FIG. 1 the web being coated is brought onto the belt 2 from the left and the web 1 is taken onto the surface of the belt 2 via the creasing roll 18 such that the web 1 travels between the roll 18 and the belt 2 which is creased over the roll.

By varying the angle of incidence $\alpha$ of the belt 2 the web 1 can be made to come into contact with the film transfer roll 3 as smoothly as possible and by controlling the angle of departure $\beta$ the formation of a surface pattern can be controlled. The main effect of these control measures, however, is to vary the time during which the web 1 and the film transfer roll 3 are in contact. By varying the contact time and the length of the contact distance it is possible to control the transfer of the coating from the roll 3 onto the web. The belt also reduces possible vibrations due to the splitting of the coating film, which for its part renders greater web speeds possible. In addition, such angles of incidence and departure can be sought that, under certain operating conditions, as little coating fume as possible is generated when the web is detached from the press nip.

By means of the present invention it is possible to carry out the duplex coating method using conventional coating apparatuses. In the embodiment depicted in FIG. 2, the blade coater comprises a short-dwell coater and the film transfer coater is an apparatus where the coating is metered onto the film transfer roll 3 by means of an applicator rod 5. The web 1 to be coated is brought to the film transfer roll 3 by means of an arrangement comprising a backing roll 4, belt-guiding rolls 7, 8, and a belt 2. The belt-guiding rolls 7, 8 are arranged on both sides of the backing roll 4 on the incoming side of the web 1 and on the departure side. The diameter of the guide rolls 7, 8 is smaller than that of the backing roll 4 whereby the belt 2 travels guided by the rolls along a triangular path and touches the backing roll 4 at two points on opposite sides of its axis. The first touching point is the nip formed by the backing roll 4 and the film transfer roll 3, where the backing roll 4 presses the belt 2 against the film transfer roll. On the opposite side of this nip there is the short-dwell coater 6 by means of which a second coating layer is applied onto the surface of the web 1 against the belt 2 and the backing roll 4. The web leaves the short-dwell coater 6 via the guide roll 9 for the web 1.

Figure 2:
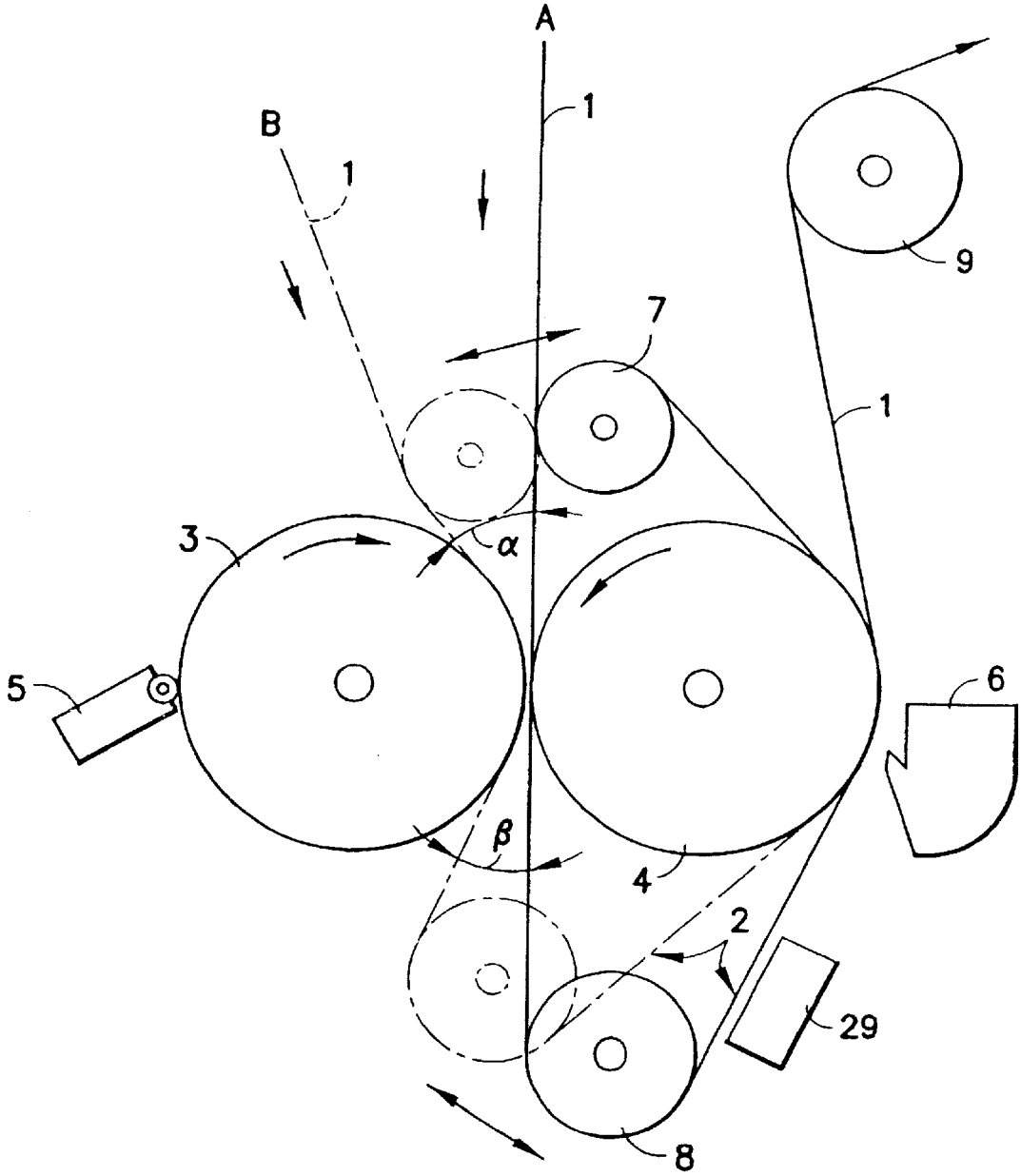
FIG. 2 is a schematic representation of a double coating method according to the present invention.

As shown in FIG. 2, the belt-guiding rolls 7, 8 are movable. In the first extreme position of the guide rolls 7, 8 their external surfaces are on the same line as the external surface of the backing roll 4, whereby the belt 2 and the web 1 traveling on said belt enter the nip between the film transfer roll 3 and the backing roll 4 along a straight line from direction A. Both belt-guiding rolls 7, 8 can be moved toward the film transfer roll 3 either independently or simultaneously with the other roll. By moving the toll 7 on the incoming side it is possible to influence the angle of incidence of the web as well as the length of the application distance and the application time before the nip. The second extreme position of the incoming angle of the web is depicted with a dashed line, and in this extreme position the web 1 comes in from direction B. The second extreme position of the guide roll 8 on the departure side is also depicted with a dashed line. In addition to the application time, the angle on the departure side can also be used to affect splitting of the coating layer when the web leaves the film transfer roll 3. The angle of departure is selected such that an applied coating layer which is as smooth as possible is obtained.

In addition to the incoming angle and the angle of departure of the web and the application time, it is also possible to control the application pressure between the film transfer roll 3 and the belt 2. This is only possible when a belt is used, for the pressure in a nip between two rolls only affects a short section in the nip, and even if the touching angle between the web and the applicator roll was longer, only little force can be exerted to press the web against the applicator roll by increasing the web tension. In the present invention, a pressure effect of long duration is exerted towards the web, by means of which pressure effect the water contained in the coating is efficiently absorbed by the web and the coating is dried, whereby the first coating layer will withstand coating performed using a doctor blade without difficulty.

Figure 4:
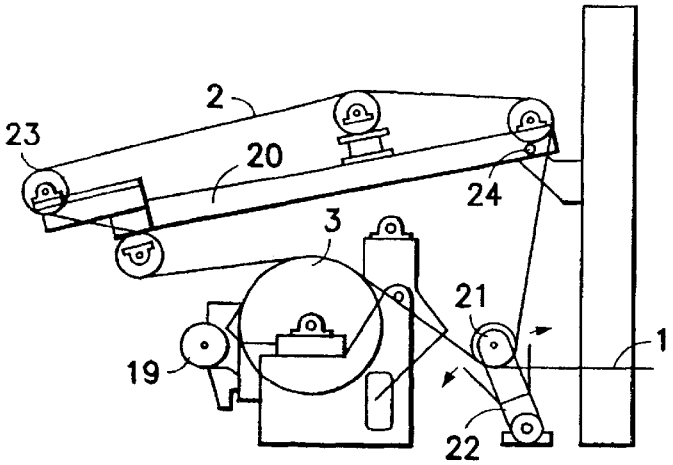
FIG. 4 depicts a second film transfer coater according to the present invention.

In FIG. 4 a coater is depicted where even the coating mix applicator 19 is schematically shown and where the path of the belt and the control of the incoming angle and the angle of departure of the web is arranged in a manner differing slightly from that depicted in FIG. 1. In this embodiment most of the rolls guiding the web are fixed to a uniform frame 20 arranged above the coater, which frame is attached to the stationary frame construction by means of a joint 24. The frame 20 can be turned in relation to the joint, thereby changing the incoming angle of the web 1 and the belt 2 to the film transfer roll 3 as well as the contact distance. On the departure side of the film transfer roll 3 the belt 3 and the web 1 are guided by means of a roll 21 fixed to a swivel shaft 22. The control of the angle of departure is thus carried out by turning the shaft 22. The tension of the belt 2 and the compensation of the distance covered by the belt 2 are performed by means of amovable roll 23 fixed to the frame 20. In this embodiment no backing roll is used; instead, the application pressure is obtained directly by varying the belt tension.

Figure 5:
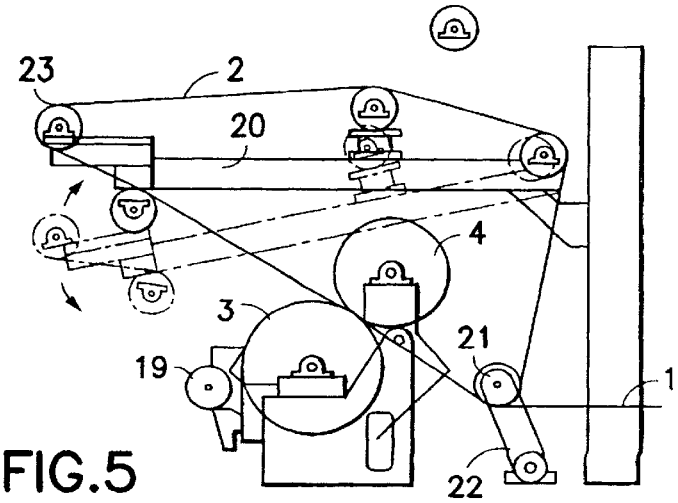
FIG. 5 depicts a third film transfer coater according to the present invention.

FIG. 5 depicts the arrangement of FIG. 4 and the frame 20 which supports the rolls guiding the belts 2 in two different positions. In addition this embodiment is provided with a backing roll 4 in order to obtain a greater application pressure. As shown FIG. 5, when a backing roll 4 is used, the control range of the incoming angle is in principle greater because the web 1 and the belt 2 can be taken directly into the nip between the backing roll 4 and the film transfer roll 3. If no backing roll is used, the length of the path covered under mutual contact must usually be greater in order to ensure a sufficient and smooth transfer of coating, whereby the belt 2 must be creased more over the film transfer roll 3.

Figure 6:
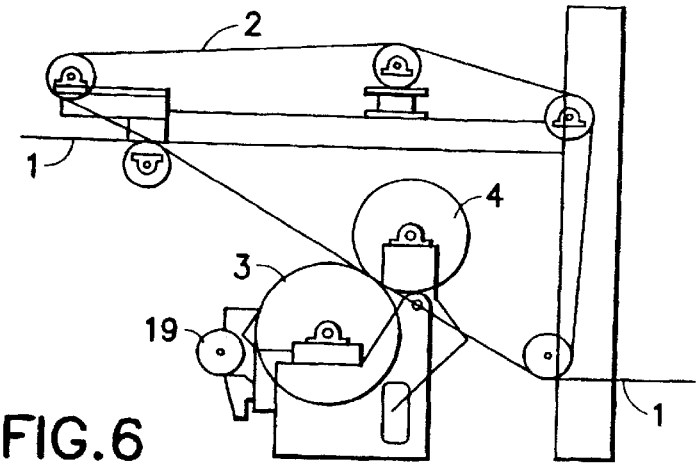
FIG. 6 depicts a fourth film transfer coater according to the present invention.

FIG. 6 depict an embodiment where the rolls guiding the supporting belt 2 are arranged in fixed positions. In this embodiment the length of the path covered under mutual contact and the incoming angle and the angle of departure can only be altered by altering the mounting points of the rolls. Here, the belt 2 naturally does not circulate round the backing roll but travels in a loop such that its outside presses the web 1 against the film transfer roll 3.

Figure 7:
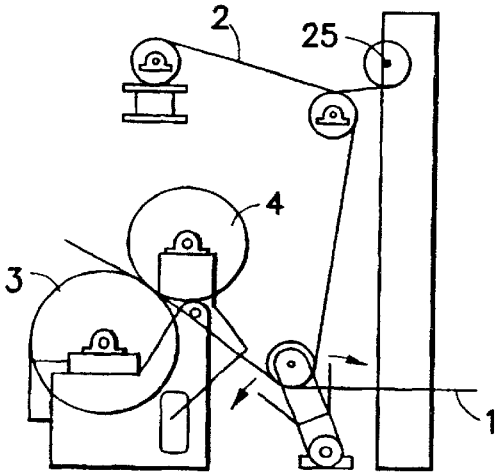
FIG. 7 depicts a fifth film transfer coater according to the present invention.
Figure 8:
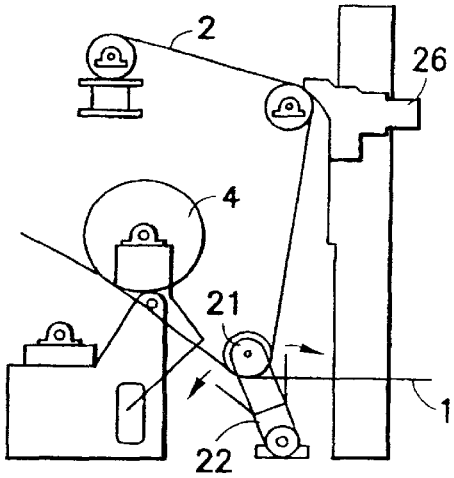
FIG. 8 depicts a sixth film transfer coater according to the present invention.
Figure 9:
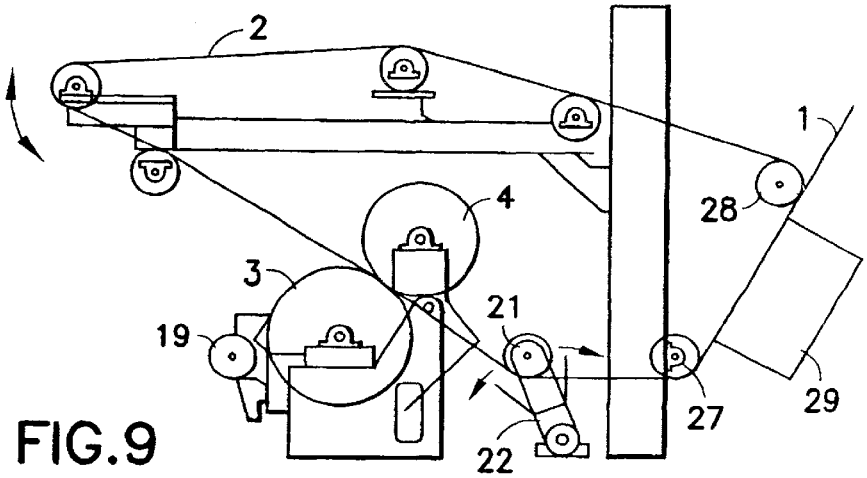
FIG. 9 depicts a seventh film transfer coater according to the present invention.

In the embodiment of FIG. 7 a doctor knifes 25 cleansing the belt is shown, the doctor knife 25 being positioned after the point of separation of the belt 2 and the web 1. The doctor knife 25 is needed in particular in the case of paper grades which are easily penetrated by coating mix, whereby the belt supporting the web is easily soiled. As the belt may become soiled even due to other reasons than penetration of coating, it may be advisable to use a doctor blade in any case. In FIG. 8 the doctor blade is replaced by a cleanser 26 which may use a liquid jet or an air or steam jet, whereby there, is no need to mechanically touch the belt. An embodiment is shown in FIG. 9 where the loop of the supporting belt 2 is continued by two guide rolls 27 and 28 after the roll 21 which controls the angle of departure. The web leaves the belt 2 at the roll 28 after the second guide roll 21 on the side of departure and before this roll a dryer 29 operating against the web 1 and the belt 2 is arranged. The dryer 29 may comprise an infrared or some other radiating device, a microwave or some other electromagnetic radiating dryer, a blast dryer, a coanda dryer or some other dryer where the web is supported by means of the flow, a one-sided inverted drying funnel, or a corresponding device.

Figure 10:
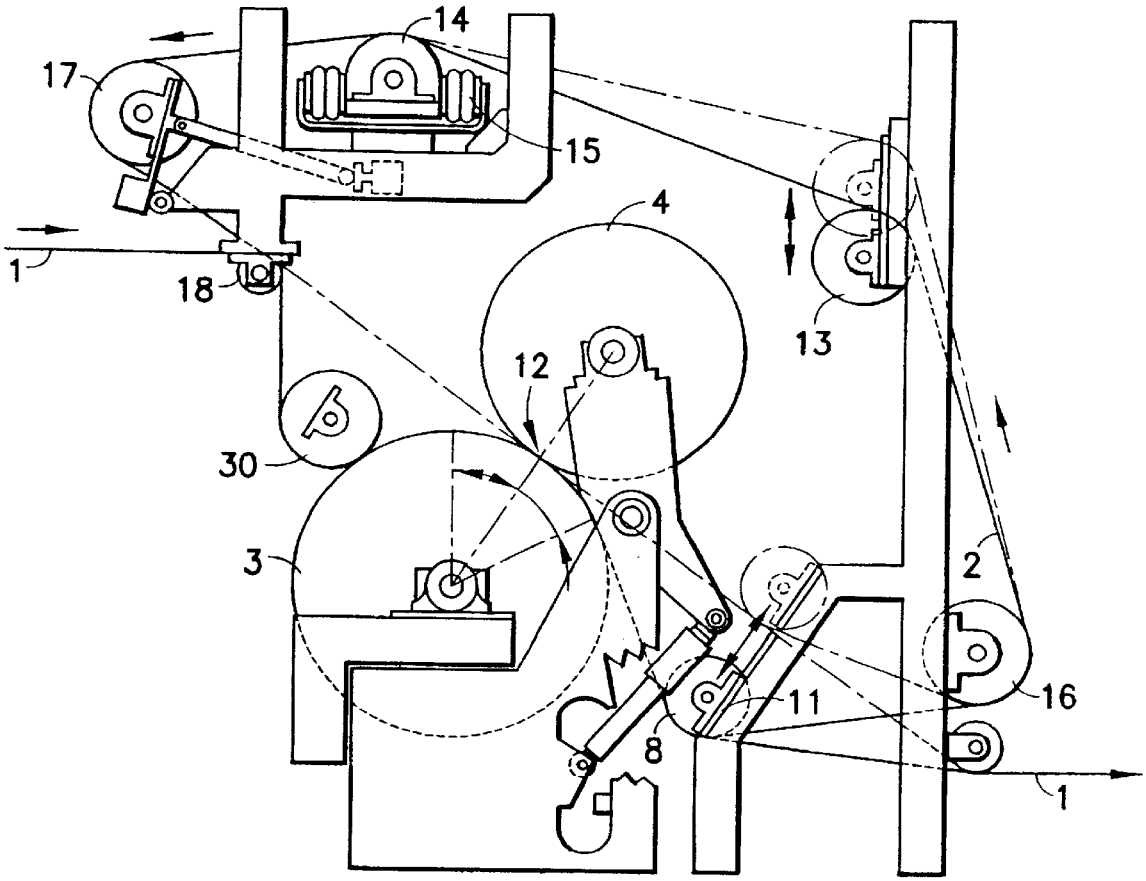
FIG. 10 depicts a tenth film transfer coater according to the present invention.

An embodiment is depicted in FIG. 10 where the belt 2 and the web 1 are pressed against the film transfer roll 3 by means of an auxiliary backing roll 30 in order to form a precise and straight contact line between the web 1 and the film transfer roll 3. The auxiliary backing roll must be movable and, if necessary, it must be possible to control the nip pressure between the auxiliary backing roll and the film transfer roll 3, like the nip pressure between the film transfer roll and the backing roll.

In addition to the above, the present invention also has other embodiments.

The duplex coating may also be performed by first applying a first coating layer onto the web by means of a blade coating method, eg. by means of a short-dwell coater, whereafter a second coating layer is applied by means of a film transfer roll. In this manner a smooth surface is obtained even if a film transfer roll is used to apply the second layer, because the blade coating evens out the surface of the web, whereby even a smooth second layer is obtained. The surface quality is further improved by the fact that by means of the belt it is possible to effectively control applicator roll coating, whereby a coating of a quality exceeding previous coating qualities is obtained. In addition to film transfer coating, any known coating method may be used as the application method, but methods based on blade or rod doctoring provide the greatest benefits because they can be used to combine the contour-type coverage of film transfer coating with the smooth surface obtained by blade doctoring. Blade coating may be performed by means of short-dwell type apparatuses such as are described above or by some other means, e.g. by using roll application, die application or a corresponding method and successive doctoring using a rod or a blade.

It is clear that the path of the belt and the number of guide and backing rolls may be selected freely according to needs, but if, e.g., each applicator has its own backing roll, a more expensive construction results. One or several guide rolls may be provided and they can be moved independently or synchronously connected to each other. Instead of a rod, the doctor means of the film transfer coater may comprise some other doctor means. Intermediate drying may be applied between the blade coating and the film transfer coating, whereby the amounts of coating applied may be increased and better use can be made of the prelayer.

Thus, while there have been shown and described and pointed out fundamental novel features of the present invention as applied to a preferred embodiment thereof, it will be understood that various omissions and substitutions and changes in the form and details of the devices illustrated, and in their operation, may be made by those skilled in the art without departing from the spirit of the present invention. For example, it is expressly intended that all combinations of those elements and/or method steps which perform substantially the same function in substantially the same way to achieve the same results are within the scope of the invention. Substitutions of elements from one described embodiment to another are also fully intended and contemplated. It is also to be understood that the drawings are not necessarily drawn to scale but that they are merely conceptual in nature. It is the intention, therefore, to be limited only as indicated by the scope of the claims appended hereto.

What is claimed is:

1. A method for coating a paper or board web comprising:

introducing the web to be coated to a film transfer coater and taking the web to a film transfer roll of the film transfer coater;

applying coating mix onto a circumferential surface of the film transfer roll;

moving the web forward while in contact with a portion of the circumferential surface of the film transfer roll and rotating the film transfer roll so that coating mix applied onto the circumferential surface of the film transfer roll is at least partially transferred onto a surface of the web;

supporting the web with a belt traveling at the same speed as the web, the belt traveling in a continuous loop and being positioned so that an outside surface of the belt on the outside of the loop supports the web, and presses the web against a portion of the circumferential surface of the film transfer roll, so that the outside surface of the belt comes in contact with the web before the web contacts the film transfer roll and is separated from the web after the web has left the film transfer roll, and so that a length of the portion of the circumferential surface of the film transfer roll in pressurized contact with the web pressed by the belt is adjustable by changing the positions of the belt and the web relative to the film transfer roll;

passing the web supported by the belt through a nip formed by the film transfer roll and a backing roll; and pressing the web in the nip against the film transfer roll with the backing roll.

2. The method of claim 1, wherein the length of the portion of the circumferential surface of the film transfer roll in contact with the web is adjusted by altering an incoming angle of the web and the belt onto the film transfer roll.

3. The method of claim 1, wherein the length of the portion of the circumferential surface of the film transfer roll in contact with the web is adjusted by altering an outgoing angle of the web and the belt from the film transfer roll.

4. The method of claim 1, wherein the length of the portion of the circumferential surface of the film transfer roll in contact with the web is adjusted by altering an incoming angle of the web and the belt onto the film transfer roll and an outgoing angle of the web and the belt from the film transfer roll.

5. The method of claim 1, further comprising:

applying a layer of coating mix onto the coated surface of the web;

supporting the web with the belt as the web travels from the film transfer roll to where the layer of coating mix is applied onto the coated surface of the web; and supporting the web while the layer of coating mix is applied to the coated surface of the web.

6. The method of claim 5, wherein the layer of coating mix is applied to the coated surface of the web before the coated surface of the web has dried completely.

7. The method of claim 5, further comprising at least partially drying the coated surface of the web before the layer of coating mix is applied to the coated surface of the web.

8. The method of claim 5, wherein the layer of coating mix applied onto the coated surface of the web is applied by a film transfer coater.

9. The method of claim 8, further comprising evening out the layer of coating mix applied onto the coated surface of the web.

10. The method of claim 5, further comprising supporting the belt with the backing roll while the belt is supporting the web during application of the layer of coating mix to the coated surface of the web.

11. The method of claim 1, further comprising cleaning the belt with a doctor knife after the web has separated from the belt.

12. The method of claim 11, wherein cleaning of the belt is accomplished with a cleaning apparatus operating with at least one of a liquid, air and a steam jet.

13. The method of claim 1, further comprising, before the web is separated from the belt, at least partially drying the web.

14. The method of claim 13, wherein drying of the web is accomplished with at least one of an infrared dryer, a radiating dryer, a microwave dryer, an electromagnetic radiative dryer, an overhead blast dryer, a coanda dryer, and a one-sided inverted funnel dryer.

15. The method of claim 1, further comprising pressing the web against the film transfer roll with an auxiliary backing roll, and aligning the web onto the film transfer roll by adjustment of a position of the auxiliary backing roll.

16. An apparatus for coating a paper or board web comprising:

a film transfer coater for applying a coating mix onto a surface of a web comprising a film transfer roll and a means for applying coating mix onto a circumferential surface of said film transfer roll; and at least one web guide means positioned to guide the web to contact a portion of the circumferential surface of said film transfer roll so that coating mix applied to the film transfer roll is at least partially transferred onto the surface of the web, said web guide means comprising a belt and a belt guide means for guiding the belt, said belt traveling in a continuous loop and being positioned and guided by the belt guide means so that an outside surface of said belt on the outside of the loop supports the web and presses the web against a portion of the circumferential surface of said film transfer roll, so that the outside surface of said belt comes in contact with the web before the web contacts said film transfer roll and is separated from the web after the web has left said film transfer roll, and so that a length of the portion of the circumferential surface of said film transfer roll in pressurized contact with the web pressed by said belt is adjustable by changing the positions of said belt and the web relative to said film transfer roll, said belt guide means comprising a backing roll positioned so that the web supported by said belt passes through a nip formed by said backing roll and said film transfer roll, said backing roll being positioned to press the web against said film transfer roll.

17. The apparatus of claim 16, wherein said web guide means further comprises an upstream guide roll, a position of said upstream guide roll being adjustable so that the length of the portion of the circumferential surface of said film transfer roll in contact with the web is adjustable by altering the position of said upstream guide roll to alter an incoming angle of the web and said belt onto said film transfer roll.

18. The apparatus of claim 16, wherein said web guide means further comprises a downstream guide roll, a position of said downstream guide roll being adjustable so that the length of the portion of the circumferential surface of said film transfer roll in contact with the web is adjustable by altering the position of said downstream guide roll to alter an outgoing angle of the web and said belt from said film transfer roll.

19. The apparatus of claim 16, wherein said web guide means further comprises an upstream guide roll and a downstream guide roll, a position of said upstream guide roll and a position of said downstream guide roll being adjustable so that the length of the portion of the circumferential surface of said film transfer roll in contact with the web is adjustable by altering the position of said upstream guide roll to alter an incoming angle of the web and said belt onto said film transfer roll and by altering the position of said downstream guide roll to alter an outgoing angle of the web and said belt from said film transfer roll.

20. The apparatus of claim 16, further comprising an auxiliary coater positioned to apply a layer of coating mix onto the web, said auxiliary coater being positioned downstream of said film transfer coater.

21. The apparatus of claim 20, further comprising a dryer to at least partially dry the web and positioned downstream of said film transfer coater and upstream of said auxiliary coater.

22. The apparatus of claim 20, wherein said belt guide means comprises a backing roll positioned so that the web supported, by said belt passes through a nip formed by said backing roll and said film transfer roll and so that said backing roll supports said belt as coating mix is applied to the web by said auxiliary coater.

23. The apparatus of claim 20, wherein said auxiliary coater comprises a means for applying coating mix to the web and a doctor means for removing excess coating applied to the web by said auxiliary coater and for smoothing the applied coating mix.

24. The apparatus of claim 16, further comprising means for adjusting pressure in the a nip formed by said backing roll and said film transfer roll.

25. The apparatus of claim 16, further comprising a cleaner apparatus positioned to clean said belt after the web has separated from said belt.

26. The apparatus of claim 25, wherein said cleaner apparatus cleans said belt with at least one of a liquid, air and a steam jet.

27. The apparatus of claim 16, further comprising a dryer positioned to at least partially dry the web and positioned downstream of said film transfer coater before the web is separated from said belt.

28. The apparatus of claim 27, wherein said dryer comprises at least one of an infrared dryer, a radiating dryer, a microwave dryer, an electromagnetic radiative dryer, an overhead blast dryer, a coanda dryer, and a one-sided inverted funnel dryer.

29. The apparatus of claim 16, further comprising an auxiliary backing roll positioned to press the web against the film transfer roll and to align the web on the film transfer roll by adjustment of a position of said auxiliary backing roll.

* * * * *